US009469144B2

(12) United States Patent
Awano

(10) Patent No.: US 9,469,144 B2
(45) Date of Patent: Oct. 18, 2016

(54) POST-PROCESSING DEVICE

(71) Applicant: FUJI XEROX CO., LTD., Tokyo (JP)

(72) Inventor: Hiroaki Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/462,070

(22) Filed: Aug. 18, 2014

(65) Prior Publication Data

US 2015/0266328 A1 Sep. 24, 2015

(30) Foreign Application Priority Data

Mar. 24, 2014 (JP) ..... 2014-059394

(51) Int. Cl.

| | |
|---|---|
| ***B42C 1/12*** | (2006.01) |
| ***B42B 4/00*** | (2006.01) |
| ***B42C 19/02*** | (2006.01) |
| ***B42C 19/08*** | (2006.01) |
| ***B41L 43/06*** | (2006.01) |
| ***B41L 43/12*** | (2006.01) |
| ***B31F 5/00*** | (2006.01) |
| ***B65H 37/04*** | (2006.01) |
| ***B65H 31/36*** | (2006.01) |
| ***B65H 45/18*** | (2006.01) |
| ***B65H 45/30*** | (2006.01) |
| ***G03G 15/00*** | (2006.01) |

(52) U.S. Cl.

CPC . *B42C 1/12* (2013.01); *B31F 5/00* (2013.01); *B31F 5/001* (2013.01); *B41L 43/06* (2013.01); *B41L 43/12* (2013.01); *B42B 4/00* (2013.01); *B42C 19/02* (2013.01); *B42C 19/08* (2013.01); *B65H 31/36* (2013.01); *B65H 37/04* (2013.01); *B65H 45/18* (2013.01); *B65H 45/30* (2013.01); *G03G 15/6544* (2013.01); *B65H 2301/42146* (2013.01); *B65H 2301/4505* (2013.01); *B65H 2513/512* (2013.01); *B65H 2513/514* (2013.01); *B65H 2701/1313* (2013.01); *B65H 2801/27* (2013.01); *B65H 2801/48* (2013.01); *G03G 2215/00877* (2013.01); *G03G 2215/00936* (2013.01)

(58) Field of Classification Search

CPC ..... B42C 1/12; B41L 43/06; B41L 43/12; B31F 5/00; B31F 5/001; B65H 37/04; B65H 2301/4505

USPC ..... 270/32, 37, 45, 58.07

See application file for complete search history.

(56) References Cited

U.S. PATENT DOCUMENTS

| | | | | |
|---|---|---|---|---|
| 6,276,677 | B1 * | 8/2001 | Hommochi et al. | 270/32 |
| 7,331,572 | B2 * | 2/2008 | Yamada et al. | 270/37 |
| 7,472,901 | B2 * | 1/2009 | Nishimura et al. | 270/58.12 |
| 7,744,076 | B2 * | 6/2010 | Suzuki | B42C 1/12 270/58.07 |
| 7,802,779 | B2 * | 9/2010 | Kamiya | 270/45 |
| 8,690,141 | B2 * | 4/2014 | Sugiyama | 270/32 |

* cited by examiner

FOREIGN PATENT DOCUMENTS

| | | |
|---|---|---|
| JP | A-2007-45531 | 2/2007 |
| JP | B2-4523515 | 8/2010 |

*Primary Examiner* — Leslie A Nicholson, III

(74) *Attorney, Agent, or Firm* — Oliff PLC

(57) ABSTRACT

Provided is a post-processing device including a stacking section that aligns and stacks recording materials which are sequentially transported, a saddle stitching section that binds plural sheets of recording materials in central portions of the recording materials, a center folding section that folds the plural sheets of recording materials into two in the central portions, a pressing section that presses a booklet in a thickness direction of the booklet, and a discharge section that discharges the booklet, which is pressed by the pressing section, with a folded portion of the booklet being a leading portion, wherein the booklet is held and stopped in a state of being nipped by the discharge section, and transport is initiated after the lapse of a predetermined stop time so that the booklet is discharged.

10 Claims, 4 Drawing Sheets

POST-PROCESSING DEVICE

CROSS-REFERENCE TO RELATED APPLICATIONS

This application is based on and claims priority under 35 USC 119 from Japanese Patent Application No. 2014-059394 filed Mar. 24, 2014.

BACKGROUND

Technical Field

The present invention relates to a post-processing device.

SUMMARY

According to an aspect of the invention, there is provided a post-processing device including:

a stacking section that aligns and stacks recording materials which are sequentially transported;

a saddle stitching section that binds plural sheets of recording materials, which are stacked on the stacking section, in central portions of the recording materials;

a center folding section that folds the plural sheets of recording materials, which are bound in the central portions by the saddle stitching section, into two in the central portions;

a pressing section that presses a booklet, which is formed of the plural sheets of recording materials center-folded by the center folding section, in a thickness direction of the booklet; and a discharge section that discharges the booklet, which is pressed by the pressing section, with a folded portion of the booklet being a leading portion, wherein the booklet is held and stopped in a state of being nipped by the discharge section, and transport is initiated after the lapse of a predetermined stop time so that the booklet is discharged.

BRIEF DESCRIPTION OF THE DRAWINGS

Exemplary embodiments of the present invention will be described in detail based on the following figures, wherein.

DETAILED DESCRIPTION

Figure 1:
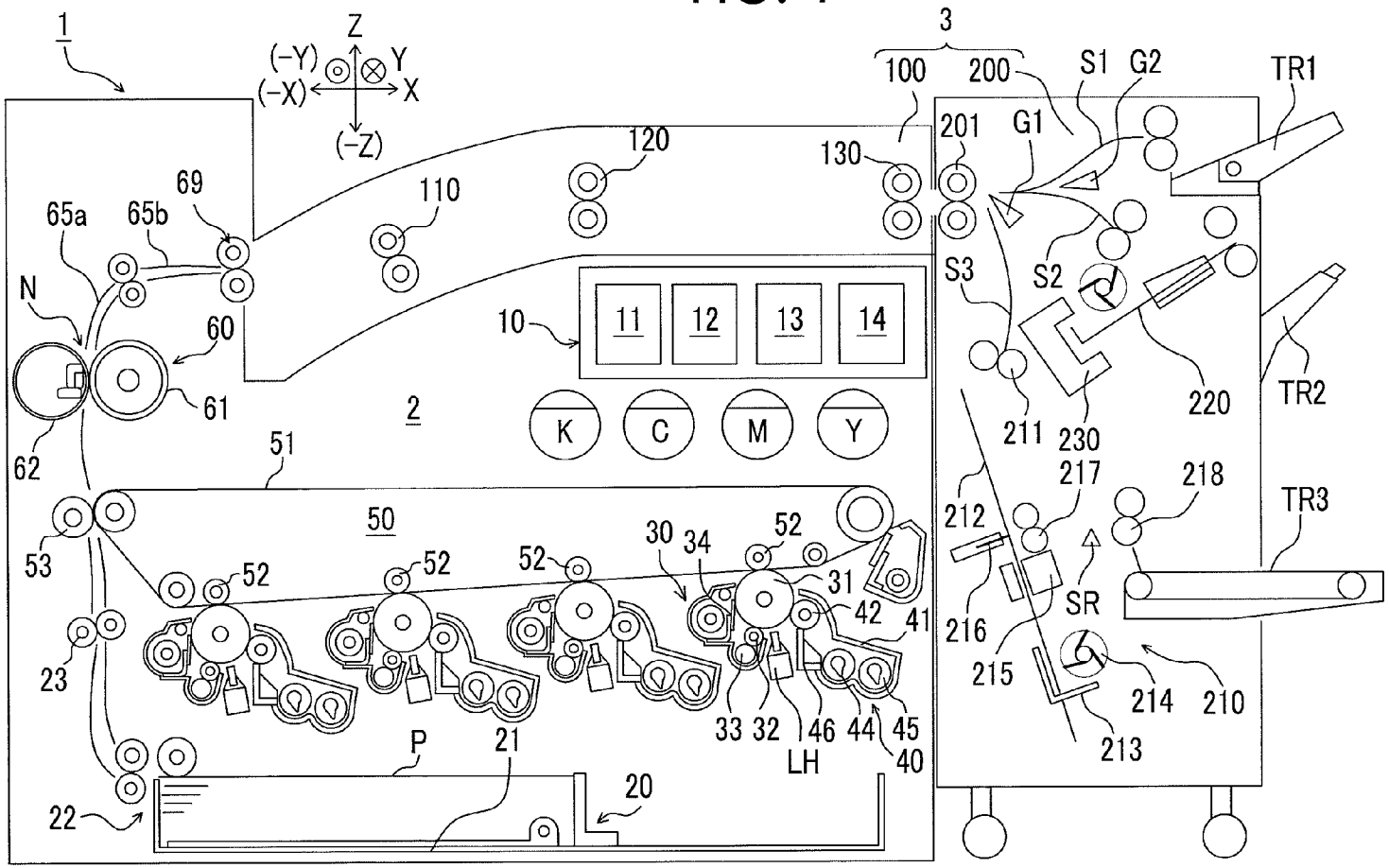
FIG. 1 is a schematic cross-sectional view showing the internal configuration of an image forming system.

Hereinafter, exemplary embodiments and specific examples of the invention will be described in further detail with reference to the accompanying drawings. However, the invention is not limited to the exemplary embodiments and specific examples.

In addition, it should be noted that the drawings that are used for the following description are schematic, the ratios of dimensions and the like are different from actual ones, and only the members that are required for the description are shown for ease of understanding.

Hereinafter, the front-back direction is referred to as an X-axis direction, the left-to-right direction is referred to as a Y-axis direction, and the up-and-down direction is referred to as a Z-axis direction in the drawings for ease of understanding of the following description.

First Exemplary Embodiment (1) Overall Configuration and Operation of Image Forming System FIG. 1 is a schematic configurational view showing an image forming system 1 to which a post-processing device according to this exemplary embodiment is applied. The image forming system 1 that is shown in FIG. 1 includes an image forming apparatus 2 such as a printer and a copying machine that forms an image by an electrophotography method, and a sheet processing device 3 that performs post-processing on a sheet P as a recording material where a toner image is formed by the image forming apparatus 2. Hereinafter, the overall configuration and operation of the image forming system 1 will be described with reference to the drawing.

(1.1) Overall Configuration and Operation of Image Forming Apparatus

The image forming apparatus 2 is configured to have a control device 10, a sheet feeding device 20, photoconductor units 30, developing devices 40, a transfer device 50, and a fixing device 60. A transport device 100 is arranged on an upper surface (Z direction) of the image forming apparatus 2, and the sheet P on which an image is recorded is guided to a post-processing device 200.

The control device 10 has an image forming apparatus control unit 11 that controls the operation of the image forming apparatus 2, a controller unit 12 that prepares image data in response to a print processing request, an exposure control unit 13 that controls the lighting of an exposure device LH, a power supply device 14, and the like. The power supply device 14 applies a voltage to charging rollers 32, developing rollers 42, primary image transfer rollers 52, a secondary image transfer roller 53, and the like (described later), and supplies power to the exposure device LH.

The controller unit 12 converts printing information that is input from an external information transmission device (for example, a personal computer, and the like) to image information for forming a latent image, and outputs a driving signal to the exposure device LH at a timing set in advance. An LED head where light emitting diodes (LED) are linearly arranged constitutes the exposure device LH according to this exemplary embodiment.

The sheet feeding device 20 is disposed in a bottom portion of the image forming apparatus 2. The sheet feeding device 20 has a sheet stacking plate 21, and the multiple sheets P as a recording medium are stacked on an upper surface of the sheet stacking plate 21. The sheets P that are stacked on the sheet stacking plate 21 with width-direction positions determined by a regulating plate (not shown) are drawn out forward (−X direction), sheet by sheet from an upper side, by a sheet drawing unit 22, and then are transported to a nip portion of an resist roller pair 23.

The photoconductor units 30 are disposed in parallel above the sheet feeding device 20 (Z direction), and have photosensitive drums 31 that are image holding members which are rotationally driven. The charging rollers 32, the exposure device LH, the developing devices 40, the primary image transfer rollers 52, and cleaning blades 34 are arranged in the direction of rotation of the photosensitive drums 31. Cleaning rollers 33 that clean surfaces of the charging rollers 32 are arranged to face and be in contact with the charging rollers 32.

The developing devices 40 have developing housings 41 in which developers are accommodated. The developing roller 42 that is arranged to face the photosensitive drum 31 is arranged in the developing housing 41 with a pair of augers 44 and 45, which agitate and transport the developer to the developing roller 42 side, obliquely downward on a back surface side of the developing roller 42. Layer regulating members 46 that regulate the layer thicknesses of the developers are arranged close to the developing rollers 42.

The respective developing devices 40 have substantially similar configurations with the exception of the developers that are accommodated in the developing housings 41, and form yellow (Y), magenta (M), cyan (C), and black (K) toner images.

Surfaces of the rotating photosensitive drums 31 are charged by the charging rollers 32, and electrostatic latent images are formed by latent image forming light which is emitted from the exposure device LH. The electrostatic latent images that are formed on the photosensitive drums 31 are developed as toner images by the developing rollers 42.

The transfer device 50 has an intermediate image transfer belt 51 where the toner images of the respective colors that are formed with the photosensitive drums 31 of the respective photoconductor units 30 are subjected to multi layer transfer, and the primary image transfer rollers 52 that sequentially transfer (primary image transfer) the toner images of the respective colors which are formed with the respective photoconductor units 30 to the intermediate image transfer belt 51. Further, the secondary image transfer roller 53 that collectively transfers (secondary image transfer) the toner images of the respective colors which are superposed on the intermediate image transfer belt 51 and transferred to the sheet P as the recording medium also constitutes the transfer device 50.

The toner images of the respective colors which are formed with the photosensitive drums 31 of the respective photoconductor units 30 are sequentially and electrostatically transferred (primary image transfer) onto the intermediate image transfer belt 51 by the primary image transfer rollers 52 to which a predetermined transfer voltage is applied from, for example, the power supply device 14 controlled by the image forming apparatus control unit 11, and a superposed toner image is formed with the toner of the respective colors superposed.

The superposed toner image on the intermediate image transfer belt 51 is transported to an area where the secondary image transfer roller 53 is arranged (secondary image transfer section T) in response to the movement of the intermediate image transfer belt 51. At the timing when the superposed toner image is transported to the secondary image transfer section T, the sheet P is supplied to the secondary image transfer section T from the sheet feeding device 20. A predetermined transfer voltage is applied to the secondary image transfer roller 53 from the power supply device 14 controlled by the image forming apparatus control unit 11, and the multiple toner images on the intermediate image transfer belt 51 are collectively transferred onto the sheet P sent out from the resist roller pair 23 and guided by a transport guide.

The residual toner on the surfaces of the photosensitive drums 31 is removed by the cleaning blades 34 and is recovered into a waste developer accommodating portion. The surfaces of the photosensitive drums 31 are charged again by the charging rollers 32. The residue that is not removed by the cleaning blades 34 and is attached to the charging rollers 32 is captured and accumulated on surfaces of the cleaning rollers 33 which rotate in contact with the charging rollers 32.

The fixing device 60 has a heating module 61 and a pressure module 62, and a fixing nip portion N (fixing area) is formed by an urge area of the heating module 61 and the pressure module 62.

The sheet P where the toner image is transferred in the transfer device 50 is transported to the fixing device 60 through the transport guide in a state where the toner image is not fixed. The toner image is fixed onto the sheet P, which is transported to the fixing device 60, through crimping and heating effects by the pair of the heating module 61 and the pressure module 62.

The sheet P on which the fixed toner image is formed is guided by transport guides 65*a* and 65*b*, and is discharged from a discharge roller pair 69 to the transport device 100 that is arranged on the upper surface of the image forming apparatus 2.

(1.2) Configuration and Operation of Sheet Processing Device

The sheet processing device 3 has the transport device 100 that transports the sheets P which are output from the image forming apparatus 2 to the further downstream side, and the post-processing device 200 that has a saddle stitching and folding processing mechanism 210 which performs saddle stitching and folding processing on the sheets P brought in from the transport device 100 to manufacture a booklet, a compile tray 220 which collects and bundles the sheets P, an edge-binding mechanism (binding unit) 230 which binds end portions of the sheets P, and the like.

The transport device 100 has an inlet roller 110 that receives the sheet P which is output via the discharge roller pair 69 of the image forming apparatus 2, a first transport roller 120 that transports the sheet P which is received by the inlet roller 110 to the downstream side, and a second transport roller 130 that transports the sheet P toward the post-processing device 200.

The post-processing device 200 has a first post-processing transport path S1, a second post-processing transport path S2, and a third post-processing transport path S3 on the downstream side of a receiving roller 201 that receives the sheets P via the transport device 100, and the first post-processing transport path S1, the second post-processing transport path S2, and the third post-processing transport path S3 are selected by a switching gate G1. In addition, the first post-processing transport path S1 and the second post-processing transport path S2 are selected by a switching gate G2.

The first post-processing transport path S1 is connected to a top tray TR1, and the sheet P that is not subjected to post-processing is discharged from the first post-processing transport path S1.

The second post-processing transport path S2 is connected to the compile tray 220 that is disposed on the downstream side, and a sheet bundle PB that is produced by the edge-binding mechanism (binding unit) 230 is discharged to a stacker tray TR2.

The third post-processing transport path S3 is connected to the saddle stitching and folding processing mechanism 210, and the booklet that is produced with the saddle stitching and folding processing mechanism 210 is nipped by a pair of folding rollers 217 and is discharged from a discharge roller 218 to a booklet tray TR3.

(2) Configuration and Operation of Saddle Stitching and Folding Processing Mechanism As shown in FIG. 1, the saddle stitching and folding processing mechanism 210 has a saddle stitching compile tray 212 that stacks a required number of the sheets P where the images are formed by the image forming apparatus 2 during the production of the booklet, a positioning stopper 213 that is moved along the saddle stitching compile tray 212 so as to determine a saddle stitching position and a folding position, a paddle 214 that aligns the sheets P which are stacked on the saddle stitching compile tray 212 toward the positioning stopper 213, and a saddle stitching stapler 215 that performs saddle stitching on the sheets P which are stacked on the saddle stitching compile tray 212.

The saddle stitching and folding processing mechanism 210 further has a folding knife 216 that performs center folding on the sheet bundle PB, which is subjected to saddle stitching by the saddle stitching stapler 215, from the saddle stitching position, a folding roller 217 as a pressing section that nips the sheet bundle PB where the folding by the folding knife 216 is initiated into the booklet, and the discharge roller 218 that discharges the booklet which is transported from the folding roller 217 to the booklet tray TR3.

In a case where the saddle-stitched booklet is produced, the third post-processing transport path S3 is selected by the switching gate G1, the sheet P is extruded downward from the receiving roller 201, and the sheet P is stacked on the saddle stitching compile tray 212 through a transport roller 211.

For example, the sheets P are stacked on the saddle stitching compile tray 212 by the number of sheets, for example, 5, 10, 15, and the like, set by the image forming apparatus control unit 11 of the image forming apparatus 2.

In this case, the positioning stopper 213 moves and stops so that, for example, the central parts of the sheets P are at a position of stapling by the saddle stitching stapler 215. In addition, the paddle 214 rotates toward the positioning stopper 213, presses the stacked sheets P against the positioning stopper 213, and assists in the sheet alignment.

Saddle stitching is performed on a predetermined part (for example, the central part) of the sheet bundle PB by the saddle stitching stapler 215 after a predetermined number of the sheets P are accumulated on the saddle stitching compile tray 212.

Then, the positioning stopper 213 moves upward along the saddle stitching compile tray 212, and the sheet bundle PB where the saddle stitching is completed is transported so that a folding part (for example, the central part of the sheet) is at a tip end position of the folding knife 216. The folding knife 216 is configured so that the tip of the folding knife 216 retracts downward from the saddle stitching compile tray 212 and does not protrude from a surface of the saddle stitching compile tray 212 during the stage when the sheet is stacked onto the saddle stitching compile tray 212, the stage of saddle stitching by the saddle stitching stapler 215, and the sheet transport stage after the saddle stitching.

After the sheet bundle PB is transported so that the folding position of the sheet bundle PB is changed to the tip end position of the folding knife 216, the folding knife 216 is extruded from below the saddle stitching compile tray 212 in a direction orthogonal to an accommodating surface of the saddle stitching compile tray 212 so that the tip end abuts against the sheet bundle PB.

The tip end is further extruded in an upward direction, and the sheet bundle PB is lifted and is nipped by the folding roller 217. Furthermore, the folding knife 216 is moved to a position where the sheet bundle PB is sufficiently into the folding roller 217.

In this manner, the sheet bundle PB that is folded by the folding roller 217 is transported to the discharge roller 218 as the booklet, the folded portion first, and is discharged onto the booklet tray TR3.

The booklet that is produced in this manner may swell toward both sides about the folded portion at a point of time when the booklet is discharged onto the booklet tray TR3 from the discharge roller 218. In particular, the degree of the swelling may be higher in a case where the sheet size of the sheet P which is used is small than in a case where the size is large.

In addition, it is appreciated that the swelling decreases in a case where the center folded booklet is left in a state of slight shifting and overlapping. In the post-processing device 200 according to this exemplary embodiment, the swelling of the booklet is suppressed as the booklet is nipped by the discharge roller 218 in a state where the fiber of the sheet P is kept warm and soft and is left for a certain period of time, a pressing force is applied in the direction opposite to the force in a direction to open the booklet, and the fiber of the sheet P is corrected.

(3) Operation and Effect of Saddle Stitching and Folding Processing Mechanism

Figure 2A:
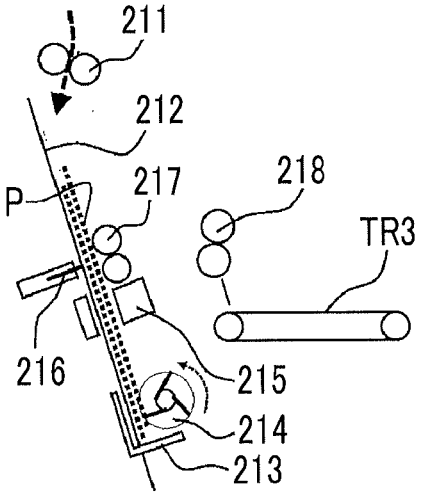
FIGS. 2A to 2F are flowcharts for describing the flow of operation of a saddle stitching and folding processing mechanism in a post-processing device.
Figure 2B:
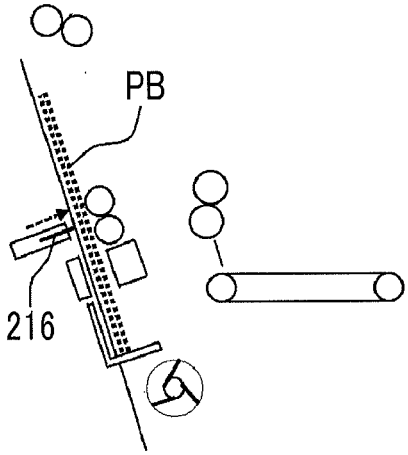
Figure 2C:
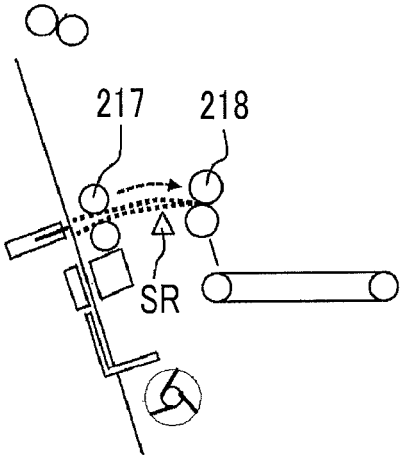
Figure 2D:
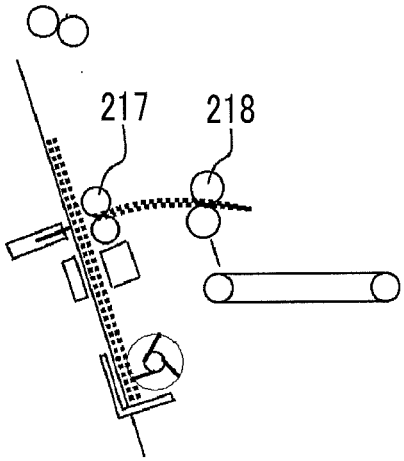
Figure 2E:
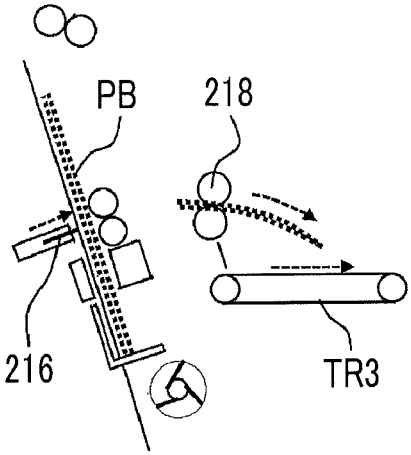
Figure 2F:
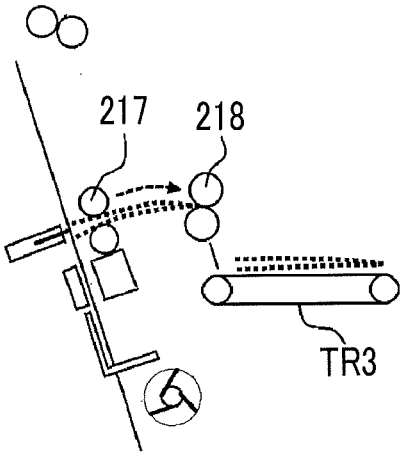
Figure 3:
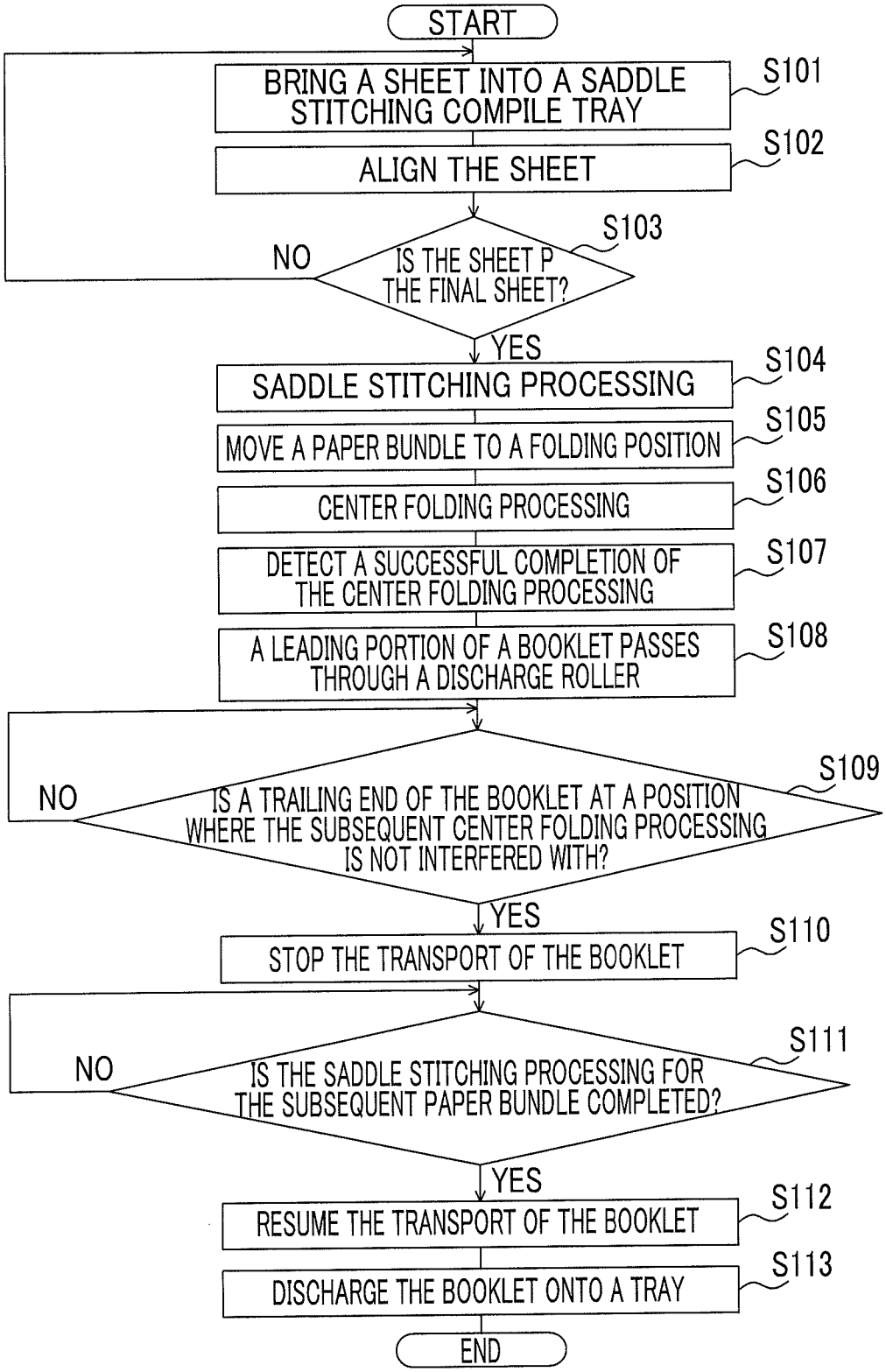
FIG. 3 is a schematic view for describing the flow of center folding processing in the saddle stitching and folding processing mechanism.
Figure 4A:
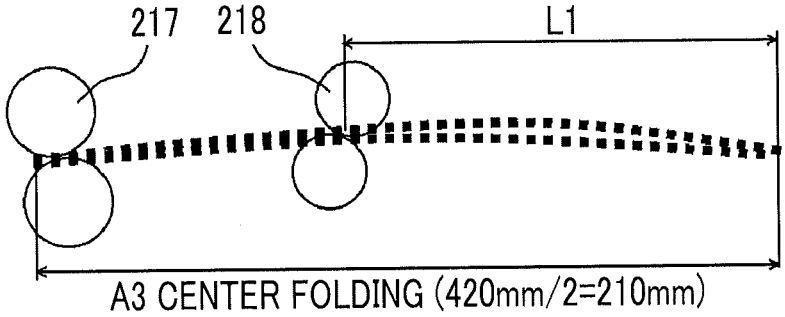
FIGS. 4A to 4C are schematic cross-sectional views for describing a state where a booklet is held in the saddle stitching and folding processing mechanism.
Figure 4B:
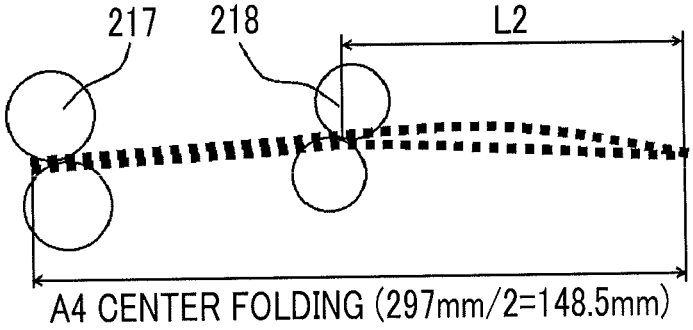
Figure 4C:
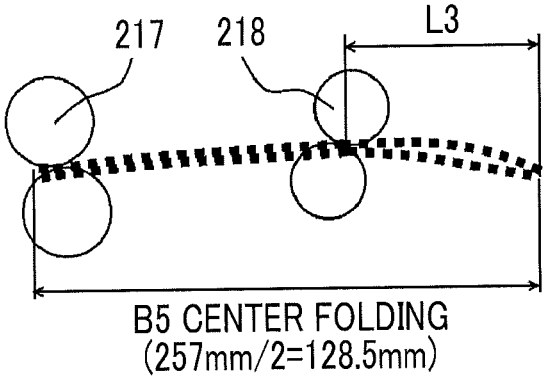

FIGS. 2A to 2F are flowcharts for describing the flow of operation of the saddle stitching and folding processing mechanism 210 in the post-processing device 200 according to this exemplary embodiment, FIG. 3 is a schematic view for describing the flow of center folding processing in the saddle stitching and folding processing mechanism 210, and FIGS. 4A to 4C are schematic cross-sectional views for describing a state where the booklet is held in the saddle stitching and folding processing mechanism 210.

Hereinafter, the flow and effect of the center folding processing in the saddle stitching and folding processing mechanism 210 will be described with reference to the accompanying drawings.

(3.1) Flow of Processing by Saddle Stitching and Folding Processing Mechanism

Firstly, the sheet P where the image is formed with the image forming apparatus 2 is brought into the saddle stitching compile tray 212 from the receiving roller 201 through the transport roller 211 (S101).

Then, it is determined, on the saddle stitching compile tray 212, whether the sheet P that is subjected to sheet alignment (S102, refer to FIG. 2A) and is brought in from the transport roller 211 is the final sheet (S103).

The determination of whether the sheet P that is brought in is the final sheet or not is performed with the number of sheets set by the image forming apparatus control unit 11 of the image forming apparatus 2.

Next, in a case where the sheet P that is brought into the saddle stitching compile tray 212 is determined to be the final sheet (S103: Yes), saddle stitching is performed by the saddle stitching stapler 215 on a predetermined part (for example, the central part) of the sheet bundle PB where the sheet alignment is performed (S104).

Then, the sheet bundle PB where the saddle stitching is completed is moved (S105, refer to FIG. 2B) so that the folding part (for example, the central part of the sheet) is at the tip end position of the folding knife 216, the tip end of the folding knife 216 is extruded to abut from a rear surface side of the sheet bundle PB, and the sheet bundle PB is lifted and is nipped by the folding roller 217 (S106, refer to FIG. 2C).

Furthermore, the folding knife 216 is moved to a position where the sheet bundle PB is sufficiently into the folding roller 217, and a successful completion of booklet folding is detected at a point of time when a leading portion of the sheet bundle PB passes beyond a sensor SR (S107).

Then, the sheet bundle PB is transported, the folded portion first, to the discharge roller 218 as the booklet and the leading portion of the booklet passes through the discharge roller 218 (S108).

Then, it is determined whether the trailing edge of the booklet is transported to a position where the subsequent center folding processing is not interfered with (S109). The determination in step S109 is performed based on the time when the leading portion of the booklet passes beyond the sensor SR and the time predicted with the sheet size information of the sheet P which is notified of by the image forming apparatus control unit 11 of the image forming apparatus 2.

In a case where the trailing edge of the booklet is transported to the position where the subsequent center folding processing is not interfered with as a result of the determination in step S109 (S109: Yes), the rotational driving of the folding roller 217 and the discharge roller 218 is stopped, the transport of the booklet is stopped, and the booklet is held in a nipped state (S110, refer to FIG. 2D).

Then, it is determined whether saddle stitching processing is completed or not with respect to the subsequent sheet bundle PB that is brought into and stacked on the saddle stitching compile tray 212 (S111). In a case where the saddle stitching processing is completed with respect to the subsequent sheet bundle PB as a result of the determination (S111: Yes), the transport of the previous booklet that is nipped and held by the folding roller 217 and the discharge roller 218 is resumed (S112, refer to FIG. 2E), and the booklet is discharged onto the booklet tray TR3 (S113, refer to FIG. 2F).

(3.2) Effect of Saddle Stitching and Folding Processing Mechanism

In the saddle stitching and folding processing mechanism 210 of the post-processing device 200 according to this exemplary embodiment, it is determined whether the trailing edge of the booklet is transported to the position where the subsequent center folding processing is not interfered with after the sheet bundle PB is transported as the booklet, the folded portion first, to the discharge roller 218 and the leading portion of the booklet passes through the discharge roller 218.

The determination of whether the trailing edge of the booklet is transported to the position where the subsequent center folding processing is not interfered with is performed based on the time when the leading portion of the booklet passes beyond the sensor SR and the time predicted with the sheet size information of the sheet P which is notified of by the image forming apparatus control unit 11 of the image forming apparatus 2.

Then, in a case where the trailing edge of the booklet is transported to the position where the subsequent center folding processing is not interfered with, the rotational driving of the folding roller 217 and the discharge roller 218 is stopped, the transport of the booklet is stopped, and the booklet is held in a nipped state.

As a result, the booklet is nipped by the discharge roller 218 and is left for a certain period of time, the pressing force is applied in the direction opposite to the force in the direction to open the booklet, the fiber of the sheet P is corrected, and the swelling of the booklet is suppressed.

In addition, as shown in FIGS. 4A to 4C, the protrusion length from the discharge roller 218 to the leading portion by sheet size is L3<L2<L1 so that the leading portion side of the booklet is nipped and held by the discharge roller 218 in a state where the trailing edge of the booklet is nipped by the folding roller 217.

In other words, the nipping position of the discharge roller 218 with respect to the booklet is closer to the leading portion in a case where the sheet size of the sheet P constituting the booklet is small, and the correction effect increases in the booklet of small size where the degree of swelling is higher than in a large size, and thus the swelling of the booklet may be suppressed.

In a case where it is determined whether the saddle stitching processing is completed or not with respect to the subsequent sheet bundle PB that is brought into and stacked on the saddle stitching compile tray 212 and the saddle stitching processing is completed with respect to the subsequent sheet bundle PB, the transport of the previous booklet that is nipped and held by the folding roller 217 and the discharge roller 218 is resumed, and the booklet is discharged onto the booklet tray TR3.

As such, the center folding processing is not discontinued, and the swelling of the booklet may be suppressed while the productivity of the post-processing is maintained.

The length of time during which the rotationally driving of the folding roller 217 and the discharge roller 218 is stopped, the transport of the booklet is stopped, and the booklet is held in a nipped state may also be determined based on the number of sheets per booklet.

The degree of swelling increases in a case where the number of sheets per booklet is large, and thus the swelling may be suppressed by lengthening the holding time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stacking section that aligns and stacks recording materials which are sequentially transported;

a saddle stitching section that binds a plurality of sheets of recording materials, which are stacked on the stacking section, in central portions of the recording materials;

a center folding section that folds the plurality of sheets of recording materials, which are bound in the central portions by the saddle stitching section, into two in the central portions;

a pressing section that presses a booklet, which is formed of the plurality of sheets of recording materials center-folded by the center folding section, in a thickness direction of the booklet; and a discharge section that discharges the booklet, which is pressed by the pressing section, with a folded portion of the booklet being a leading edge;

wherein the post-processing device is configured to be controlled by a controller such that the booklet is held and stopped in a state of being nipped by the discharge section, such that a portion of the booklet including the leading edge protrudes from the discharge section in the direction of discharge, such that the lending edge hangs free, and transport is initiated after the lapse of a predetermined stop time so that the booklet is discharged.

2. The post-processing device according to claim 1, wherein the stop time is a time until a folded portion of a subsequent booklet that is center-folded by the center folding section reaches the pressing section.

3. The post-processing device according to claim 1, wherein the stop time is determined based on the number of sheets of the recording materials, which are center-folded by the center folding section, per booklet.

4. The post-processing device according to claim 2, wherein the stop time is determined based on the number of sheets of the recording materials, which are center-folded by the center folding section, per booklet.

5. The post-processing device according to claim 1, wherein the pressing section is configured to hold and stop the booklet in a state where a trailing edge of the booklet is nipped, and the transport is initiated after the lapse of a predetermined stop time so that the booklet is discharged.

6. The post-processing device according to claim 2, wherein the pressing section is configured to hold and stop the booklet in a state where a trailing edge of the booklet is nipped, and the transport is initiated after the lapse of a predetermined stop time so that the booklet is discharged.

7. The post-processing device according to claim 3, wherein the pressing section is configured to hold and stop the booklet in a state where a trailing edge of the booklet is nipped, and the transport is initiated after the lapse of a predetermined stop time so that the booklet is discharged.

8. The post-processing device according to claim 4, wherein the pressing section is configured to hold and stop the booklet in a state where a trailing edge of the booklet is nipped, and the transport is initiated after the lapse of a predetermined stop time so that the booklet is discharged.

9. The post-processing device according to claim 1, wherein a distance between a nipping position of the discharge section and the leading edge of the booklet varies according to a sheet size of a sheet constituting the booklet, when the booklet is nipped.

10. The post-processing device according to claim 1, further comprising a sensor located between the pressing section and the discharge section.

* * * * *